US008870541B2

(12) United States Patent
Imahigashi et al.

(10) Patent No.: US 8,870,541 B2
(45) Date of Patent: Oct. 28, 2014

(54) CENTRIFUGAL MULTIBLADE FAN

(75) Inventors: Syoichi Imahigashi, Kariya (JP); Masaharu Sakai, Obu (JP); Yasushi Mitsuishi, Anjo (JP)

(73) Assignees: Denso Corporation, Kariya (JP); Nippon Soken, Inc., Nishio (JP)

( * ) Notice: Subject to any disclaimer, the term of this patent is extended or adjusted under 35 U.S.C. 154(b) by 709 days.

(21) Appl. No.: 13/065,124

(22) Filed: Mar. 15, 2011

(65) Prior Publication Data

US 2011/0229327 A1 Sep. 22, 2011

(30) Foreign Application Priority Data

Mar. 16, 2010 (JP) ..... 2010-59524

(51) Int. Cl.
*F04D 29/38* (2006.01)
*F04D 29/28* (2006.01)
*F04D 29/30* (2006.01)

(52) U.S. Cl.
CPC ..... *F04D 29/281* (2013.01); *F04D 29/30* (2013.01)
USPC ..... 416/187; 416/228

(58) Field of Classification Search
USPC ..... 416/185, 186 R, 187, 223 B, 178
See application file for complete search history.

(56) References Cited

U.S. PATENT DOCUMENTS 6,042,335 A * 3/2000 Amr ..... 415/208.1
6,695,584 B2 * 2/2004 Kim et al. ..... 416/186 R
6,769,876 B2 * 8/2004 Sakai et al. ..... 416/187
6,945,753 B2 * 9/2005 Chiang et al. ..... 416/178
7,125,226 B2 * 10/2006 Horng et al. ..... 416/203
7,281,897 B2 * 10/2007 Ochiai et al. ..... 416/184
2006/0204363 A1 * 9/2006 Yen et al. ..... 416/228
2007/0274833 A1 * 11/2007 Sakai et al. ..... 416/204 R
2009/0047133 A1 * 2/2009 Nishino ..... 416/213 A
2009/0162198 A1 6/2009 Ogino et al.

FOREIGN PATENT DOCUMENTS

| | | |
|---|---|---|
| CN | 2881168 | 3/2007 |
| EP | 1 411 248 | 4/2004 |
| JP | 2-70997 | 3/1990 |
| JP | 2-95797 | 4/1990 |
| JP | 2000-9083 | 1/2000 |
| JP | 2006-125229 | 5/2006 |
| JP | 2009-056564 | 3/2009 |

OTHER PUBLICATIONS

Office action dated May 20, 2013 in corresponding Chinese Application No. 2011 10063680.8.
Office action dated Feb. 27, 2013 in corresponding Chinese Application No. 2011 10063680.8.

* cited by examiner

*Primary Examiner* — Edward Look
*Assistant Examiner* — Michael Sehn
(74) *Attorney, Agent, or Firm* — Harness, Dickey & Pierce, PLC

(57) ABSTRACT

A centrifugal multiblade fan includes a rotatable shaft, blades, a side shroud, and a main shroud. A front edge has a shape inclined radially outward in a direction from the main shroud toward the side shroud. When viewed from an axial direction, a corner part on a positive pressure surface-side is located on a tangential line of a positive pressure surface reference curve at a positive pressure surface side reference corner part, and when viewed from the axial direction, a curvature radius of a negative pressure surface becomes larger in a direction from the side shroud toward the main shroud.

6 Claims, 6 Drawing Sheets

CENTRIFUGAL MULTIBLADE FAN

CROSS REFERENCE TO RELATED APPLICATION

This application is based on and incorporates herein by reference Japanese Patent Application No. 2010-59524 filed on Mar. 16, 2010.

BACKGROUND OF THE INVENTION

1. Field of the Invention

The present invention relates to a centrifugal multiblade fan in which many blades are arranged around a rotatable shaft, and the fan is suitably used for a blower in an air conditioning system for a vehicle.

2. Description of Related Art

Conventionally, this kind of centrifugal multiblade fan with a front edge of its blade being tapered is described in JP-A-2000-009083 and JP-A-2006-125229. "The front edge of the blade being tapered" means that the centrifugal multiblade fan is a tapered-type fan with an inner diameter of the fan on its side shroud side (suction side) being larger than on its main shroud side (opposite side from the suction side).

Specifically, in the above-described conventional technologies, by gradually making shorter a leading edge of a camber line from the main-shroud side toward the side-shroud side, an upper front edge end shape viewed from a side surface is made a generally circular arc or generally elliptical.

As an effect of the tapered-type fan, the following is described in JP-A-2000-009083. Inflow resistance can be reduced since the inner diameter is extended in a side-shroud side region serving as an inflow port, whereas on the main-shroud side serving as a mainstream of the flow, an air blowing effect is effectively produced by taking advantage of a long blade chord.

As the effect of the tapered-type fan, the following is described in JP-A-2006-125229. In a region on a side-shroud side serving as a suction part, the suction part is made large and air capacity performance thereby improves; and the distance to a blade front edge is made large to attenuate a turbulence and noise reduction is thereby achieved. On the other hand, in the other regions, static pressure is improved because chord length is long as usual.

However, in the tapered-type fan of the above conventional technologies, on the side-shroud side, exfoliation at the blade front edge is easily caused, and performance degradation is thereby caused. This problem will be described below.

FIGS. 8A to 8C are diagrams illustrating problems of these conventional technologies.

Angles β1' and β2' in FIGS. 8B and 8C indicate inlet angles at the respective cross sections. The inlet angle is an angle between a tangential line of the positive pressure surface 1215 at a corner part 1217 on a positive pressure surface 1215-side; and a tangential line of a blade row line (alternate long and two short dashes line in FIGS. 8B and 8C) at the corner part 1217 on the positive pressure surface 1215-side, on respective cross sections of blades 121 (cross-sectional surface when the blade 121 is cut in a direction perpendicular to a rotatable shaft). The positive pressure surface 1215 is a surface of the blade 121 on a rotational direction R'-side, and a negative pressure surface 1216 is a surface on the opposite side from the rotational direction R'.

As is evident from FIGS. 8B and 8C, an inlet angle β2' on a cross section taken along a line VIIIC-VIIIC on a side shroud 122-side is much larger than an inlet angle β1' on a cross section taken along a line VIIIB-VIIIB on a main shroud 123-side. More specifically, in this comparative example, a front end of a camber line is made shorter toward the side shroud 122. Accordingly, directions of the front ends of the camber lines are significantly different between the side shroud 122-side and the main shroud 123-side. As a result, the inlet angles are also significantly different between the side shroud 122-side and the main shroud 123-side.

Therefore, in the centrifugal multiblade fan; as indicated by arrows in FIG. 8A, a change of an air flowing direction (change from a rotation axis direction to a radial direction) is comparatively gradual on the main shroud 123-side, whereas the change of the air flowing direction is rapid on the side shroud 122-side. Accordingly, inflow velocity on the side shroud 122-side is slower than on the main shroud 123-side. Moreover, a peripheral speed at a blade front edge is greater on the side shroud 122-side having a larger inner diameter than on the main shroud 123-side having a smaller inner diameter.

Thus, to limit the exfoliation at the blade front edge, it is desirable that the inlet angle should be made smaller from the main shroud 123-side toward the side shroud 122-side. However, in the above-described comparative example, contrarily, the inlet angle β2' on the side shroud 122-side is larger than the inlet angle β1' on the main shroud 123-side. Accordingly, discrepancy between an inflow condition (inflow velocity) and the inlet angle is made significant on the side shroud 122-side. Hence, the exfoliation at the blade front edge is caused, and eventually, performance degradation is caused.

SUMMARY OF THE INVENTION

The present invention addresses at least one of the above disadvantages.

According to the present invention, there is provided a centrifugal multiblade fan for drawing air from one end side of the fan in an axial direction of the fan and for blowing out the air radially outward of the fan. The fan includes a rotatable shaft, a plurality of blades, a side shroud, and a main shroud. The plurality of blades are arranged around the rotatable shaft. The side shroud couples together respective end portions of the plurality of blades on the one end side. The main shroud is joined to the rotatable shaft, and couples together respective end portions of the plurality of blades on the other end side of the fan in the axial direction. Each of the plurality of blades includes a corresponding positive pressure surface, a corresponding negative pressure surface, and a corresponding front edge. The positive pressure surface is located on a front side thereof in a rotational direction of the rotatable shaft. The negative pressure surface is located on a rear side thereof in the rotational direction. The front edge is located on a front side thereof in a radially inward direction. The front edge includes a corner part on a positive pressure surface-side thereof and a corner part on a negative pressure surface-side thereof. The front edge has a shape that is inclined radially outward in a direction from the main shroud toward the side shroud. Provided that: a cross section, along which a side shroud-side region of each of the plurality of blades is cut in a direction perpendicular to the rotatable shaft, is a reference cross section; a curve, which appears when the positive pressure surface is cut along the reference cross section, is a positive pressure surface reference curve; and the corner part on the positive pressure surface-side, which is on the reference cross section, is a positive pressure surface side reference corner part, when viewed from the axial direction, the corner part on the positive pressure surface-side is located on a tangential line of the positive pressure surface reference curve at the positive pressure surface side reference corner part, and when viewed from the axial direction, a curvature radius of the negative pressure surface becomes larger in a direction from the side shroud toward the main shroud.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF THE INVENTION

First Embodiment

Figure 1:
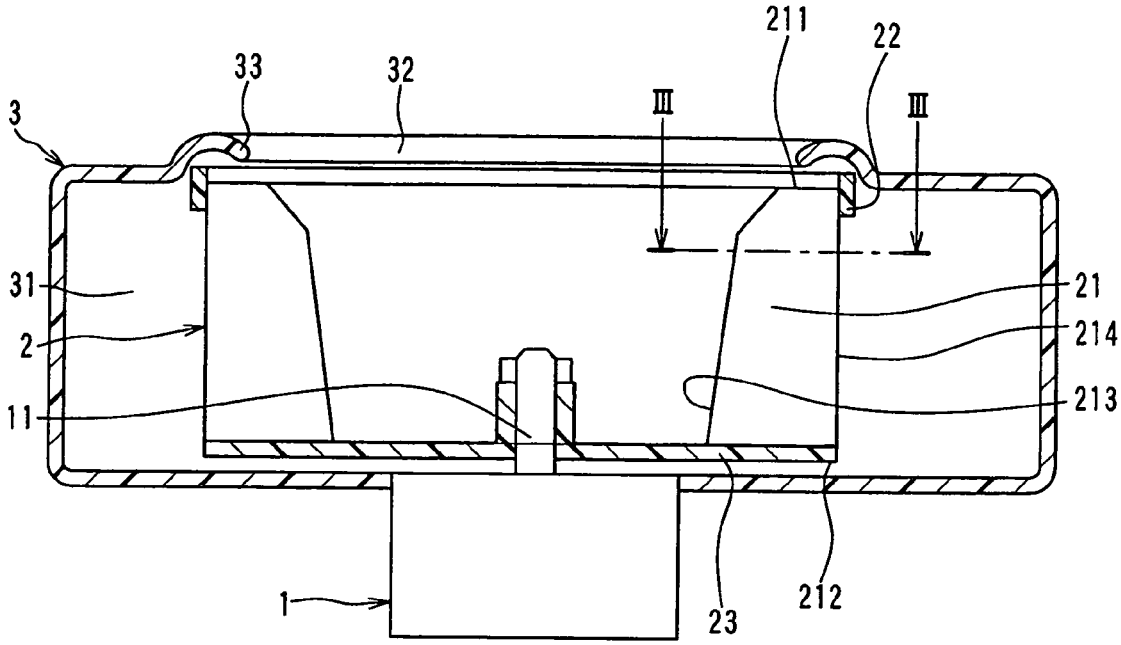
FIG. 1 is a sectional view illustrating a blower in accordance with a first embodiment of the invention.

A first embodiment of the invention will be described below with reference to the accompanying drawings. The present embodiment is an application of a centrifugal multiblade fan of the invention to a blower in an air conditioning system for a vehicle. FIG. 1 is a sectional view schematically illustrating a centrifugal blower having the centrifugal multiblade fan in the present embodiment.

The centrifugal blower includes a motor 1 that has a rotatable shaft 11; a centrifugal multiblade fan (hereinafter referred to as a fan) 2 that is rotated by the motor 1 to blow out air and made of resin; and a resin scroll casing (hereinafter referred to as a casing) 3 that accommodates the fan 2 and has an involuted passage 31, which gathers the air blown out of the fan 2.

A suction port 32 for air that opens toward one end side (upper side in FIG. 1) in a fan rotation axis direction (hereinafter referred to as an axial direction) is provided for the casing 3. A bell mouth 33 that extends toward an inner circumferential side of the fan 2 to guide intake air into the suction port 32 is formed at an outer edge part of the suction port 32.

Figure 2:
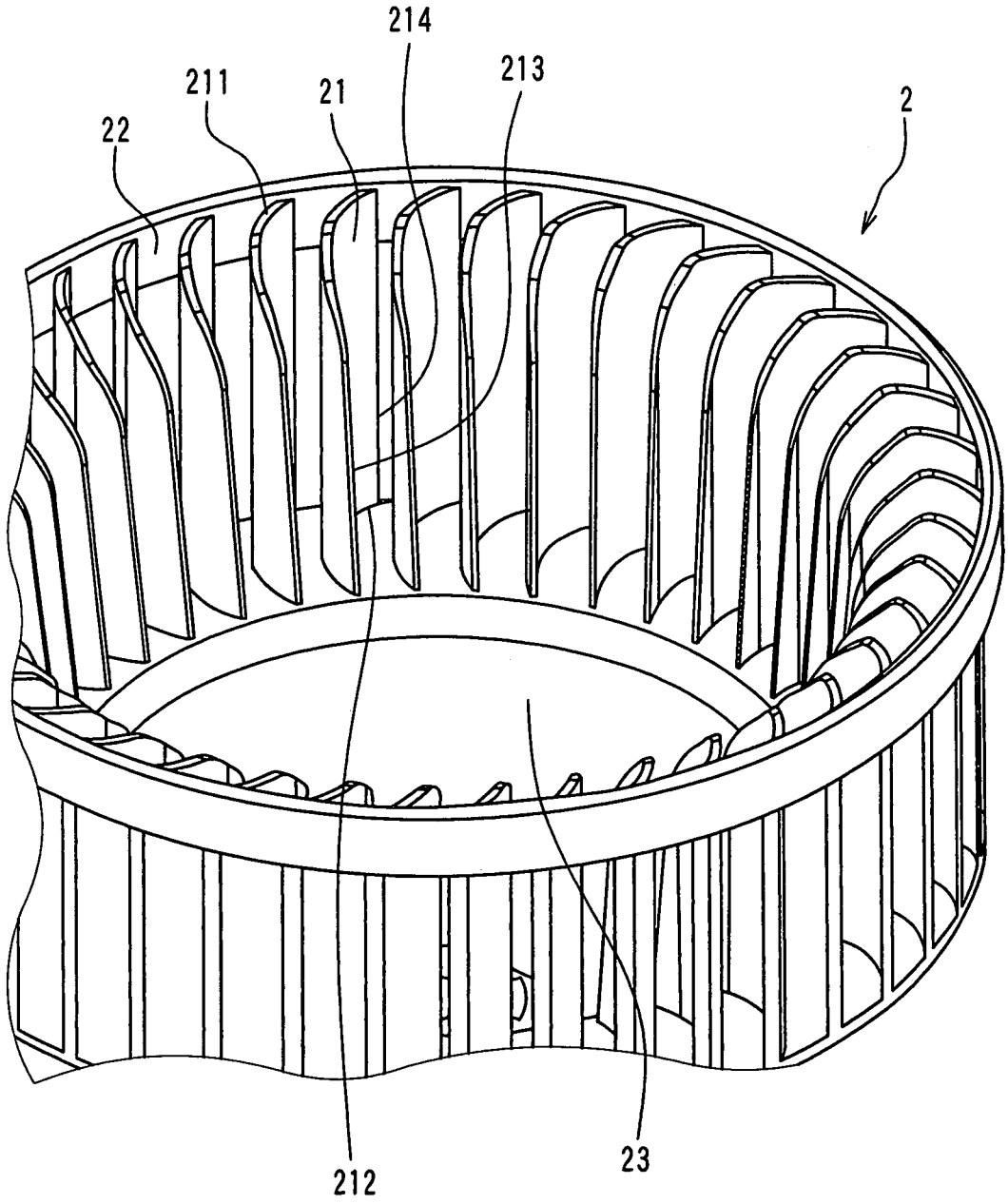
FIG. 2 is a perspective view illustrating a centrifugal multiblade fan in FIG. 1.

As illustrated in FIG. 2, the fan 2 is obtained by arranging many plate-like blades 21 around the rotatable shaft 11. End portions 211 of the blades 21 on their one end side (suction port 32-side) in the axial direction are coupled together by the side shroud 22. The side shroud 22 is formed into a ring shape covering the blade 21 from the outer side in a fan radial direction (hereinafter referred to as a radial direction). The ring-shaped side shroud 22 may cover the end portions 211 of the blades 21 from the outer side in the axial direction.

End portions 212 of the blades 21 on their other end side (opposite side from the suction port 32) in the axial direction are coupled together by the circular disk-shaped main shroud 23. The blades 21, the side shroud 22 and the main shroud 23 are integrally formed from resin. The main shroud 23 is joined to the rotatable shaft 11 at its central portion, and driving force of the motor 1 is transmitted to the fan 2 through the rotatable shaft 11 and the main shroud 23.

The fan 2 is rotated by the motor 1, so that the fan 2 draws air into the fan 2 from its one end side (side shroud 22-side) in the axial direction, and blows out the drawn air radially outward.

A specific shape of the blade 21 will be described below. As is evident from FIG. 1, a front edge 213 of the blade 21 has a shape that is inclined radially outward from the main shroud 23-side toward the side shroud 22-side. Accordingly, the fan 2 has a tapered shape such that an inner diameter of the fan 2 decreases from its one end side in the axial direction toward its other end side in the axial direction.

In the present embodiment, a rear edge 214 of the blade 21 extends parallel to a radial direction of the rotatable shaft 11 from the main shroud 23-side to the side shroud 22-side. Accordingly, an outer diameter of the fan 2 is made constant from its one end side in the axial direction toward its other end side in the axial direction.

Figure 3:
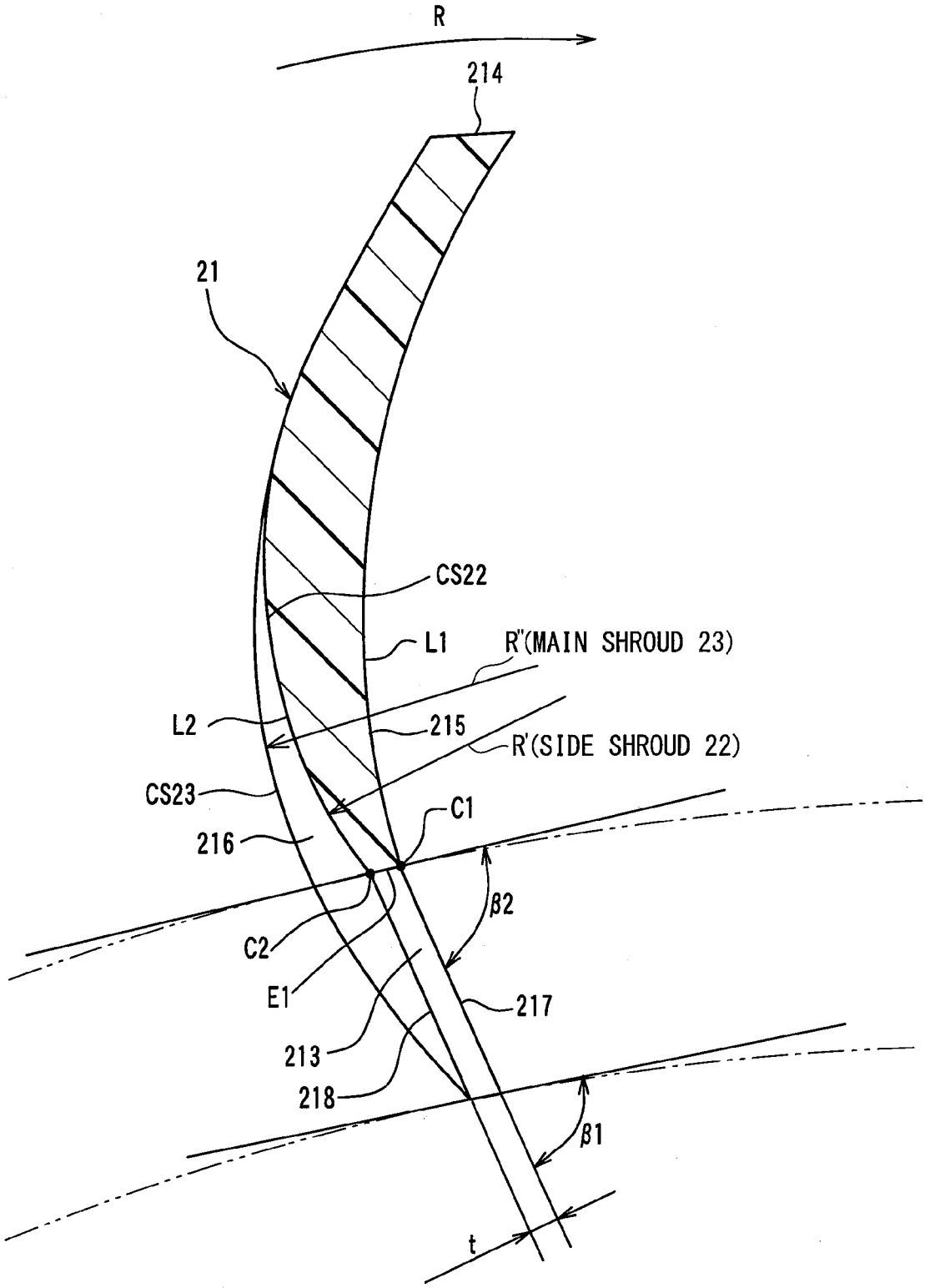
FIG. 3 is a cross-sectional view taken along a line III-III in FIG. 1.

FIG. 3 is a cross-sectional view illustrating the blade 21 in FIG. 1 taken along a line III-III. The III-III cross section is a cross-sectional surface obtained when a region of the blade 21 on the side shroud 22-side is cut in a direction perpendicular to the axial direction, and the cross section is a reference cross section that is a reference when the shape of the blade 21 is designed. An arrow R in FIG. 3 indicates a rotational direction of the fan 2.

A surface of the blade 21 on the rotational direction R-side is hereinafter referred to as a positive pressure surface 215, and a surface of the blade 21 on the opposite side from the rotational direction R is hereinafter referred to as a negative pressure surface 216.

The blade 21 has a predetermined blade thickness t at the front edge 213. Accordingly, the front edge 213 of the blade 21 includes a corner part 217 on the positive pressure surface 215-side and a corner part 218 on the negative pressure surface 216-side.

Both the corner parts 217, 218 may actually be formed in a slightly round shape due to manufacturing reasons, for example. In such a case, the corner parts 217, 218 in the present description mean an imaginary corner part on the assumption that they are formed not to be round.

The corner part 217 on the positive pressure surface 215-side is hereinafter referred to as a positive pressure surface side corner part, and the corner part 218 on the negative pressure surface 216-side is hereinafter referred to as a negative pressure surface side corner part 218.

In FIG. 3, a curved line L1 indicates a curve that appears when the positive pressure surface 215 is cut along the III-III cross section (reference cross section), and is hereinafter referred to as a positive pressure surface reference curve. In FIG. 3, a curved line L2 indicates a curve that appears when the negative pressure surface 216 is cut along the III-III cross section (reference cross section), and is hereinafter referred to as a negative pressure surface reference curve. In FIG. 3, a line segment E1 indicates the front edge 213 on the III-III cross section.

In FIG. 3, a point C1 indicates the positive pressure surface side corner part 217 on the III-III cross section, and is hereinafter referred to as a positive pressure surface side reference corner part. In FIG. 3, a point C2 indicates the corner part 218 on the negative pressure surface 216-side along the III-III cross section, and C2 is hereinafter referred to as a negative pressure surface side reference corner part.

When viewed from the axial direction as in FIG. 3, the positive pressure surface 215 of the blade 21 overlaps with the same curve. On the other hand, the negative pressure surface 216 of the blade 21 does not overlap with the same curve when viewed from the axial direction as in FIG. 3. From the side shroud 22-side toward the main shroud 23-side, a curvature radius of the negative pressure surface 216 is made larger.

When viewed from the axial direction as in FIG. 3, the positive pressure surface side corner part 217 is located on a tangential line of the positive pressure surface reference curve L1 at the positive pressure surface side reference corner part C1.

When viewed from the axial direction as in FIG. 3, the negative pressure surface side corner part 218 is located on a straight line extending parallel to the positive pressure surface reference curve L1 from the negative pressure surface side reference corner part C2. Accordingly, the blade thickness t of the front edge 213 is constant from the side shroud 22-side to the main shroud 23-side.

In FIG. 3, an angle β1 indicates an inlet angle at a region of the blade 21 on the main shroud 23-side, and an angle β2 indicates an inlet angle at a region of the blade 21 on the side shroud 22-side (specifically, III-III cross section).

The inlet angle is an angle between a tangential line of the positive pressure surface 215 at the corner part 217 on the surface 215-side, and a tangential line of a blade row line (alternate long and two short dashes line in FIG. 3) at the corner part 217 on the surface 215-side, on respective cross sections of the blades 21 (cross section when the blade 21 is cut in a direction perpendicular to the rotatable shaft 11).

In the present embodiment, as illustrated in FIG. 1, in the vicinity of an end portion of the blade 21 on the side shroud 22-side (region on the side shroud 22-side of the III-III cross-sectional surface), the blade 21 has a tapered shape that is inclined at a steeper angle than a remaining region.

Figure 4:
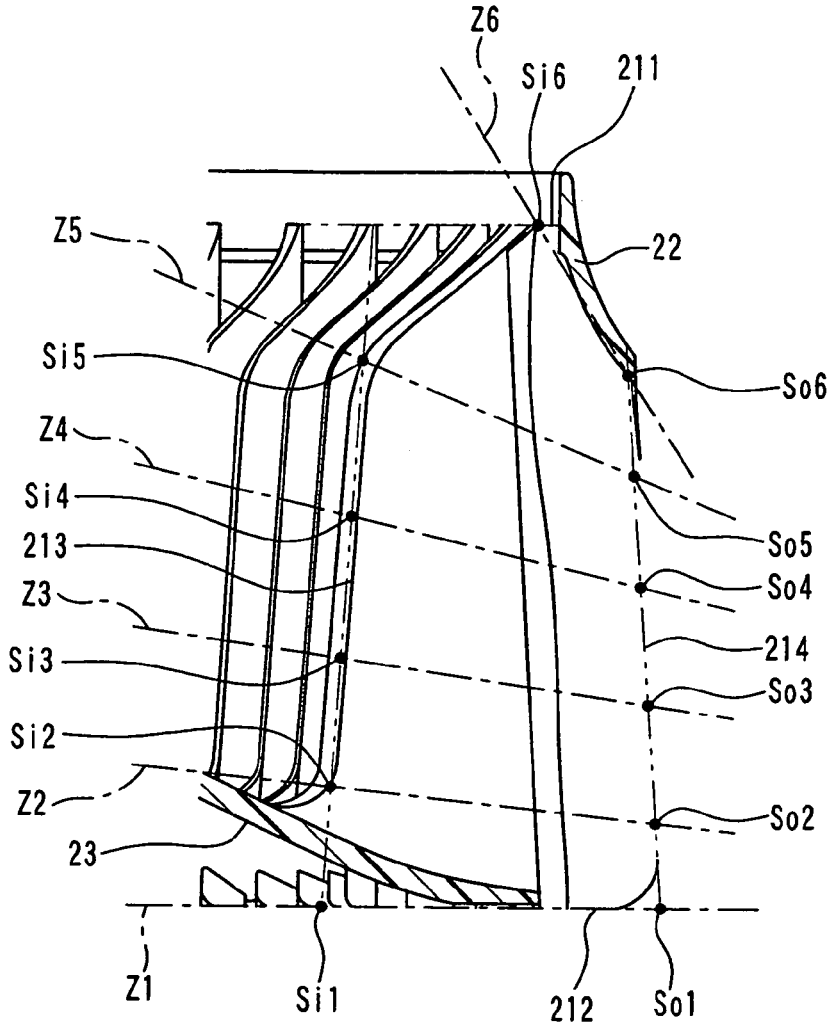
FIG. 4 is a sectional view illustrating the fan in FIG. 1.

In the present embodiment, as illustrated in FIG. 4, blade lengths on respective predetermined cross sections of the blades 21 are set to be the same.

Specifically, the front edge 213 and the rear edge 214 of the blade 21 are respectively divided equally at a predetermined number of division points (imaginary points) Si1 to Si6, and So1 to So6 such that lengths along the front edge 213 and the rear edge 214 (length along an alternate long and two short dashes line in FIG. 4) are the same. Provided that lines connecting the same-numbered division points out of this predetermined number of division points Si1 to Si6, and So1 to So6 are division lines (imaginary lines) Z1 to Z6, the respective predetermined cross sections are respective cross-sectional surfaces including these division lines Z1 to Z6. The blade length is defined as $L=(Do-Di)/2$, given that L is a blade length, Do is a fan outer diameter, and Di is a fan inner diameter.

In the example in FIGS. 1 and 2, the side shroud 22 is formed in a simple ring shape. Alternatively, as in the example in FIG. 4, the side shroud 22 may be formed into a shroud shape covering the blades 21 from radially outward. Moreover, in the example in FIGS. 1 and 2, the rear edge 214 of the blade 21 extends parallel to the radial direction of the rotatable shaft 11 from the main shroud 23-side to the side shroud 22-side. Alternatively, as in the example of FIG. 4, the rear edge 214 of the blade 21 may be inclined radially outward from the main shroud 23-side toward the side shroud 22-side.

Operation of the blower as a result of the above-described configuration will be described below. When the air conditioning system for the vehicle is activated and the motor 1 thereby rotates, the fan 2 is rotated by rotational driving force from the electric motor 1. When the fan 2 rotates, the fan 2 suctions air from the suction port 32 of the casing 3, and blows out the air into the passage 31. The air blown out into the passage 31 is blown through an air outlet (not shown) of the casing 3.

In the present embodiment, when viewed from the axial direction as in FIG. 3, the corner part 217 on the surface 215-side is located on the tangential line of the positive pressure surface reference curve L1 at the positive pressure surface side reference corner part C1. Therefore, a direction of the tangential line of the positive pressure surface 215 at the corner part 217 on the surface 215-side is the same between the main shroud 23-side and the side shroud 22-side. In other words, the direction of the front edge 213 is made equal between the side shroud 22-side and the main shroud 23-side. Accordingly, a difference between the inlet angle β1 on the main shroud 23-side and the inlet angle β2 on the side shroud 22-side is made small.

Particularly, in the present embodiment, when viewed from the axial direction, the positive pressure surface 215 of the blade 21 overlaps with the same curve. As a result, the direction of the tangential line of the positive pressure surface 215 at the corner part 217 on the surface 215-side is made exactly the same between the main shroud 23-side and the side shroud 22-side. Accordingly, a difference between the inlet angle β1 on the main shroud 23-side and the inlet angle β2 on the side shroud 22-side is made even smaller.

In the present embodiment, since the inner diameter of the fan 2 is different between the main shroud 23-side and the side shroud 22-side, a direction of the tangential line of the blade row line at the corner part 217 on the surface 215-side is different between the main shroud 23-side and the side shroud 22-side.

Thus, in the present embodiment, in which the direction of the tangential line of the positive pressure surface 215 at the corner part 217 on the surface 215-side is exactly the same between the main shroud 23-side and the side shroud 22-side, because the direction of the tangential line of the blade row line is different between the main shroud 23-side and the side shroud 22-side, a difference is made between the inlet angle β1 on the main shroud 23-side and the inlet angle β2 on the side shroud 22-side.

Figure 5:
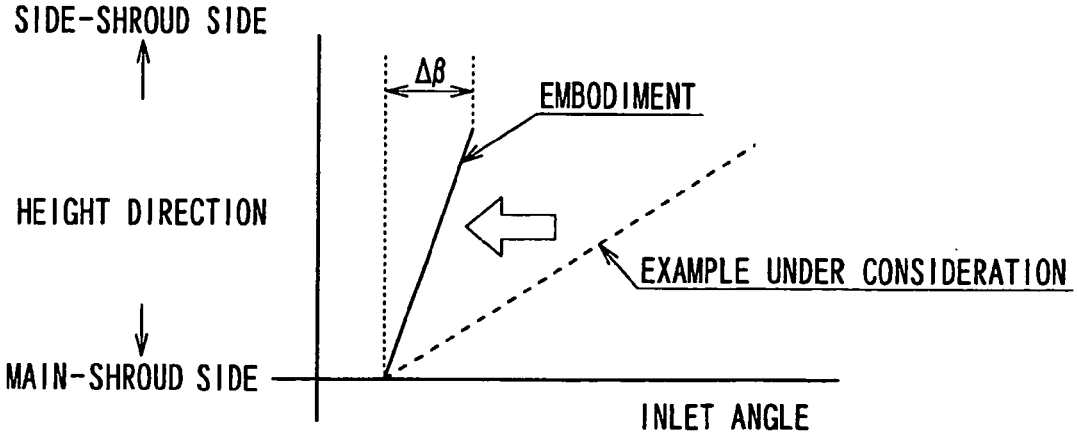
FIG. 5 is a graph illustrating by comparison an inlet angle in accordance with the first embodiment and an inlet angle in accordance with a comparative example.
Figure 8A:
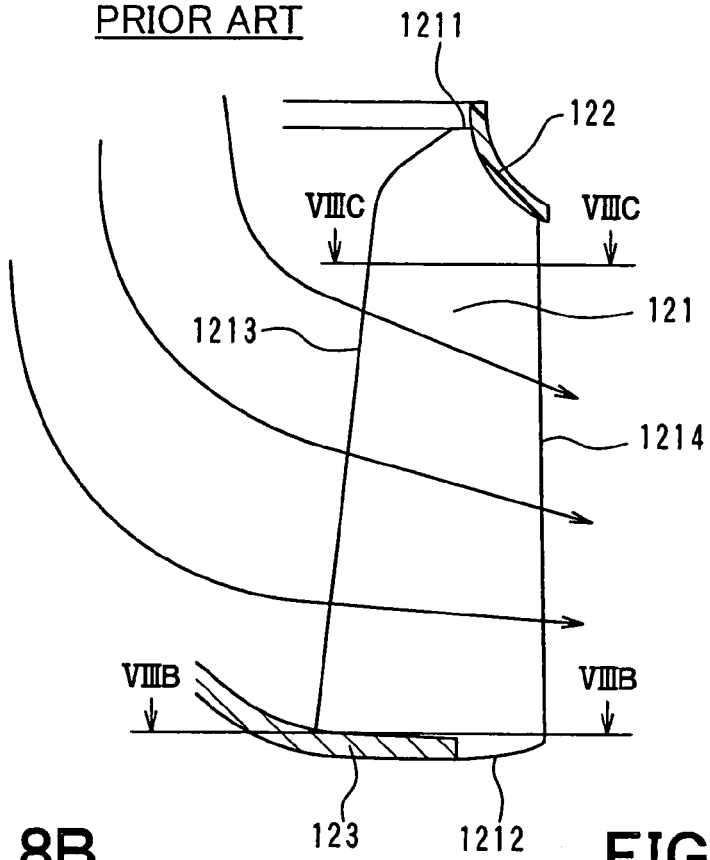
FIG. 8A PRIOR ART
FIG. 8A is a sectional view illustrating a previously proposed centrifugal multiblade fan (tapered-type fan) in a comparative example.
Figure 8B:
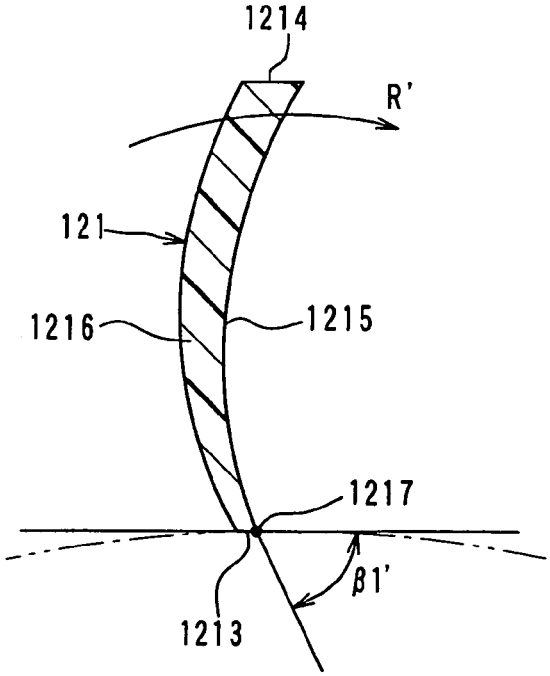
FIG. 8B PRIOR ART
FIG. 8B is a cross-sectional view on a main-shroud side taken along a line VIII-VIII in FIG. 8A.
Figure 8C:
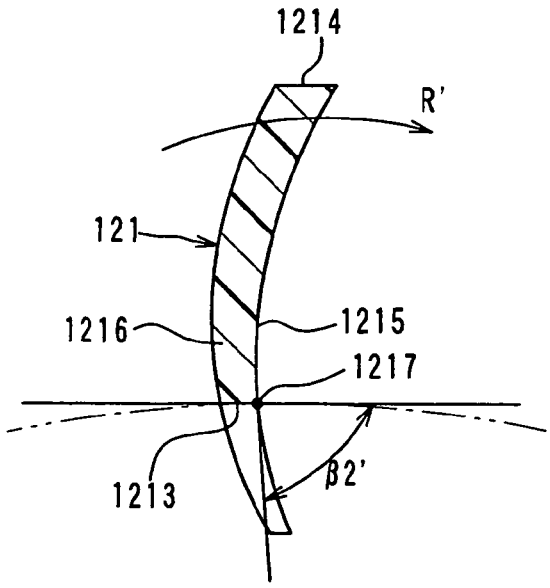
FIG. 8C PRIOR ART
FIG. 8C is a cross-sectional view on a side-shroud side taken along a line VIIIC-VIIIC in FIG. 8A.

FIG. 5 is a graph in which the inlet angles are compared between the present embodiment and the comparative example in FIGS. 8A to 8C. In FIG. 5, the case of the same inlet, angle on the main shroud-side between the present embodiment and the comparative example is taken for example.

As is evident from FIG. 5, in the present embodiment, the increase of the inlet angle from the main shroud-side toward the side shroud-side is limited compared to the above-described comparative example. Accordingly, an inlet angle difference Δβ is made small between the side shroud-side and the main shroud-side.

Hence, discrepancy between an inflow condition (inflow velocity) and the inlet angle on the side shroud-side is kept small. Accordingly, in a tapered-type fan, exfoliation at the blade front edge is limited, and eventually, performance degradation is curbed.

Furthermore, in the present embodiment, when viewed from the axial direction as in FIG. 3, the blade thickness t of the front edge 213 is made constant from the side shroud 22-side to the main shroud 23-side by making large the curvature radius of the negative pressure surface 216 of the blade 21 from the side shroud 22-side toward the main shroud 23-side. Accordingly, the exfoliation at the blade front edge is further curbed.

When viewed from the axial direction, the negative pressure surface 216 has a larger curvature radius from the side shroud 22-side toward the main shroud 23-side. As illustrated in FIG. 3, at the cross section CS22 indicated by arrows III-III in FIG. 2, blade 21 has a radius R' on the negative pressure surface 216. Arrows III-III are taken near the side shroud 22 side of blade 21. At the main shroud 23 side of blade 21, blade 21 has a radius R" on the negative pressure surface 216 at a cross section CS23. As can be seen in FIG. 3, radius R" at the main shroud 23 side is larger than radius R' at the side shroud 22 side. Accordingly, even though the corner part 217 on the positive pressure surface 215-side is located on the tangential line of the positive pressure surface reference curve L1 at the positive pressure surface side reference corner part C1, an increase of a difference of the blade thickness t at the front edge 213 between the side shroud 22-side and the main shroud 23-side is limited. Therefore, exfoliation at the blade front edge is limited.

In the present embodiment, by making the blade lengths on the respective predetermined cross sections the same as each other as in FIG. 4, the blade length of the blade 21 is sufficiently ensured on the side shroud 22-side as well. Accordingly, a after the flow exfoliated at the front edge 213 is attached again a rectification section is sufficiently secured. As a result, performance increase is achieved.

Additionally, in the present embodiment, when viewed from the axial direction, the positive pressure surface 215 of the blade 21 overlaps with the same curve, and the negative pressure surface 216 of the blade 21 has a larger curvature radius from the side shroud 22-side toward the main shroud 23-side. Accordingly, at the time of forming of the blade 21, a forming die is removed in the axial direction (upper and lower directions in FIG. 1), so that the die removal is easily done. As a result, the forming die for the blade 21 is simplified, and eventually, the production costs can be reduced.

Second Embodiment

In the first embodiment, the front edge 213 of the blade 21 is generally linearly inclined. In the present second embodiment of the invention, as illustrated in FIG. 6, a front edge 213 of a blade 21 is inclined like a quadratic curve.

More specifically, a degree of inclination of the front edge 213 of the blade 21 is made smaller from a main shroud 23-side toward a side shroud 22-side. In the present embodiment as well, an operation and effect similar to the first embodiment are produced.

Figure 6:
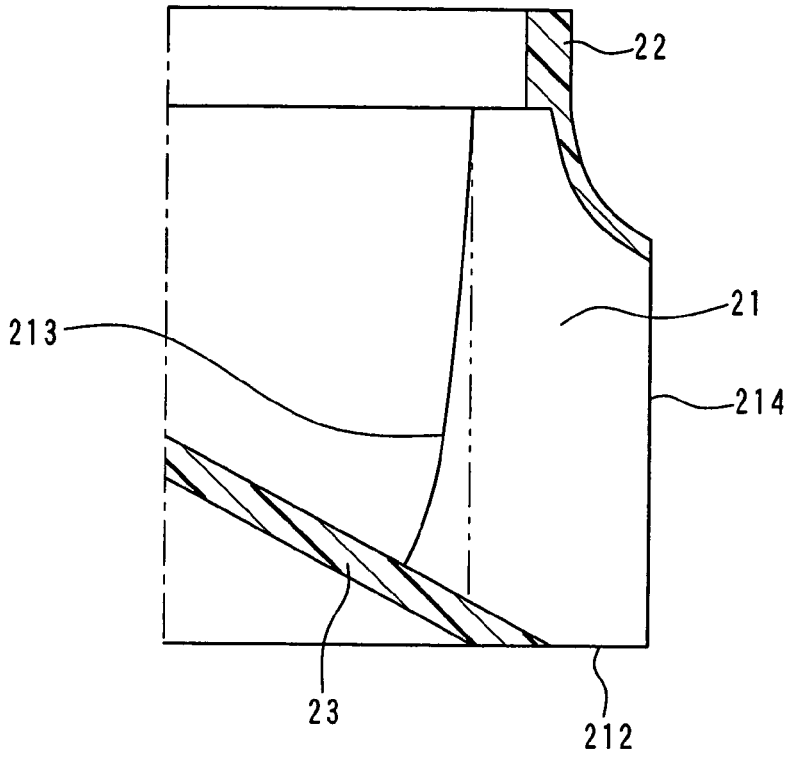
FIG. 6 is a sectional view illustrating a centrifugal multiblade fan in accordance with a second embodiment of the invention.

Incidentally, in the example in FIG. 6, a central side region of the main shroud 23 is depressed toward one end side in the axial direction (upper side in FIG. 6). By disposing a part of an electric motor 1 in this depressed part of the main shroud 23, downsizing of an axial dimension of the centrifugal blower is achieved.

Third Embodiment

Figure 7:
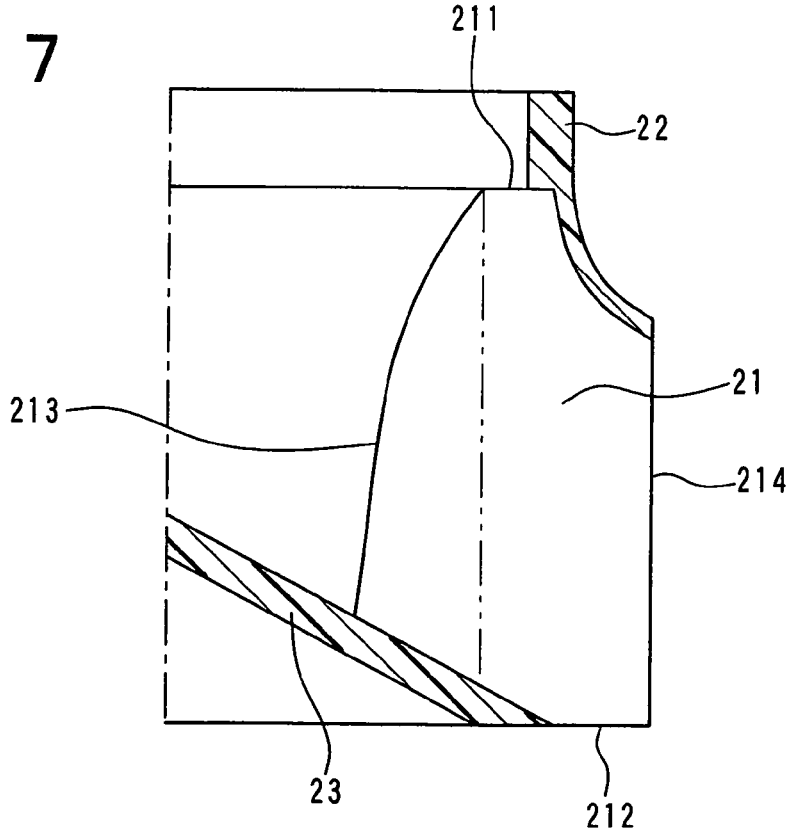
FIG. 7 is a sectional view illustrating a centrifugal multiblade fan in accordance with a third embodiment of the invention.

In the second embodiment, the front edge 213 of the blade 21 is inclined like a quadratic curve. In this third embodiment of the invention, as illustrated in FIG. 7, a front edge 213 of a blade 21 is inclined like a circular arc. Specifically, a degree of inclination of the front edge 213 of the blade 21 is made larger from the main shroud 23-side toward the side shroud 22-side. In the present embodiment as well, an operation and effect similar to the above first and second embodiments are produced.

In the above-described embodiments, the example of application of the centrifugal multiblade fan of the invention to the blower in the air conditioning system for the vehicle is illustrated. Nevertheless, the centrifugal multiblade fan of the invention is not limited to this, and the invention may be applicable to various centrifugal blowers.

Additional advantages and modifications will readily occur to those skilled in the art. The invention in its broader terms is therefore not limited to the specific details, representative apparatus, and illustrative examples shown and described.

What is claimed is:

1. A centrifugal multiblade fan for drawing air from one end side of the fan in an axial direction of the fan and for blowing out the air radially outward of the fan, the fan comprising:

a rotatable shaft;

a plurality of blades arranged around the rotatable shaft, wherein:

each of the plurality of blades includes:

a corresponding positive pressure surface located on a front side thereof in a rotational direction of the rotatable shaft;

a corresponding negative pressure surface located on a rear side thereof in the rotational direction; and a corresponding front edge located on a front side thereof in a radially inward direction; and the front edge includes a corner part on a positive pressure surface-side thereof and a corner part on a negative pressure surface-side thereof;

a side shroud coupling together respective end portions of the plurality of blades on the one end side; and a main shroud joined to the rotatable shaft and coupling together respective end portions of the plurality of blades on the other end side of the fan in the axial direction, wherein:

the front edge has a shape that is inclined radially outward in a direction from the main shroud toward the side shroud; and provided that:

a cross section, along which a side shroud-side region of each of the plurality of blades is cut in a direction perpendicular to the rotatable shaft, is a reference cross section;

a curve, which appears when the positive pressure surface is cut along the reference cross section, is a positive pressure surface reference curve; and the corner part on the positive pressure surface-side, which is on the reference cross section, is a positive pressure surface side reference corner part, when viewed from the axial direction, the corner part on the positive pressure surface-side is located on a tangential line of the positive pressure surface reference curve at the positive pressure surface side reference corner part, and when viewed from the axial direction, a curvature radius of the negative pressure surface becomes larger in the axial direction from the side shroud toward the main shroud when a comparison is made between the curvature radius of the negative pressure surface at a side shroud side portion and the curvature radius of the negative pressure surface at a main shroud side portion, the side shroud side portion and the main shroud side portion are located at the same position in a radial direction of the fan.

2. The centrifugal multiblade fan according to claim 1, wherein the curvature radius of the negative pressure surface is set such that a blade thickness of each of the plurality of blades at the corresponding front edge is constant in the direction from the side shroud toward the main shroud.

3. The centrifugal multiblade fan according to claim 1, wherein when viewed from the axial direction, the positive pressure surface overlaps with the same curve.

4. The centrifugal multiblade fan according to claim 1, wherein:

each of the plurality of blades includes a corresponding rear edge located on a rear side thereof in the radially inward direction; and provided that:

the front edge is equally divided at a predetermined number of first division points, which are numbered from one in ascending order in the direction from the main shroud toward the side shroud;

the rear edge is equally divided at a predetermined number of second division points, which are numbered from one in ascending order in the direction from the main shroud toward the side shroud; and the predetermined number of first division points and the predetermined number of second division points are connected one for one by a plurality of division lines, such that each of the predetermined number of first division points and a corresponding one of the predetermined number of second division points, which is arranged in the same order as the each of the predetermined number of first division points, are connected, each of the plurality of blades has the same blade lengths along respective cross sections including the plurality of division lines.

5. The centrifugal multiblade fan according to claim 1, wherein the front edge has a shape that is inclined like a quadratic curve when viewed from the direction perpendicular to the rotatable shaft.

6. The centrifugal multiblade fan according to claim 1, wherein the front edge has a shape that is inclined like a circular arc when viewed from the direction perpendicular to the rotatable shaft.

* * * * *